United States Patent [19]

Tani et al.

[11] Patent Number: 4,979,459

[45] Date of Patent: Dec. 25, 1990

[54] SMALL SIZED JET PROPULSION BOAT

[75] Inventors: Satoshi Tani; Hideki Kishi, both of Iwata, Japan

[73] Assignee: Yamaha Hatsudoki Kabushiki Kaisha, Iwata, Japan

[21] Appl. No.: 320,171

[22] Filed: Mar. 7, 1989

[30] Foreign Application Priority Data

Mar. 9, 1988 [JP] Japan ..... 63-31420[U]

[51] Int. Cl.[5] ..... B63B 35/73

[52] U.S. Cl. ..... 114/363; 114/270

[58] Field of Search ..... 114/270, 363, 343, 85; 441/65

[56] References Cited

U.S. PATENT DOCUMENTS 3,608,512 9/1971 Thompson ..... 114/270
3,623,447 11/1971 Jacobson ..... 114/270
4,305,603 12/1981 Muller et al. ..... 441/65
4,350,113 9/1982 Moreau et al. ..... 114/270
4,743,213 5/1988 Nishida ..... 114/270 X

FOREIGN PATENT DOCUMENTS 304822 3/1989 European Pat. Off. ..... 114/343
61-291292 12/1986 Japan ..... 114/363

*Primary Examiner*—Sherman Basinger
*Attorney, Agent, or Firm*—Ernest A. Beutler

[57] ABSTRACT

An improved hull configuration for a small watercraft wherein the rider's area floor, which opens through the rear of the hull, has an upwardly inclined rear portion that offers a brace for the rider's feet but which is sufficiently shallow so that to permit the water to be discharged from the area and not offer any significant obstruction to rear entry.

4 Claims, 5 Drawing Sheets

SMALL SIZED JET PROPULSION BOAT

BACKGROUND OF THE INVENTION

This invention relates to an improved small sized jet propulsion boat and more particularly to a hull configuration and rider floor configuration for such a watercraft.

One particularly popular type of water vessel is the type of jet propulsion boat that is designed to be operated primarily by a single rider. In many forms of this watercraft, the watercraft is steered by means of a pivotally supported steering post that is operated by a rider positioned in a rider's area formed by the hull rearwardly of the steering post. Frequently, the rider's area is defined by a generally planar floor that opens through the rear of the hull. This rear opening floor is desirable in order permit water which enters the rider's area to flow out of the rider's area and also so as to facilitate boarding of the watercraft from the rear. However, the use of such flat rearwardly opening floors presents certain disadvantages.

For example, frequently the rider shifts his position on the floor for maneuvering of the watercraft and also so as to reduce fatigue by affording different riding positions. However, the flat floors and frequent slippery conditions can give rise to some problems when the rider changes his position. In addition, such flat floors do not offer any ease for the rider to brace himself during certain types of maneuvering. Also, the flat floor may, at times, actually make it more difficult for the rider to reenter the watercraft from the rear because he has nothing on which to form a grip or foot steady.

It is, therefore, a principal object of this invention to provide an improved hull configuration and rider's area for such a watercraft.

It is a further object of this invention to provide a floor configuration for the rider's area of a small watercraft which has the advantages of the previously proposed constructions in ease of entry and ease of discharge of water and yet which offers the rider a better opportunity to brace himself and change his position.

SUMMARY OF THE INVENTION

This invention is adapted to be embodied in a hull configuration for a small watercraft that has a steering mast positioned in front of a rider's area for steering of the watercraft. The rider's area is defined by a floor that opens through the rear of the hull for permitting water to flow rearwardly from the rider's area back through the open rear end thereof. In accordance with the invention, the floor has a rear portion that is inclined upwardly toward the rear end of the hull for affording a bracing area for the rider without significantly obstructing water flow from the rider's area or interfering with rear entry to the rider's area.

DETAILED DESCRIPTION OF THE PREFERRED EMBODIMENT OF THE INVENTION

Figure 1:
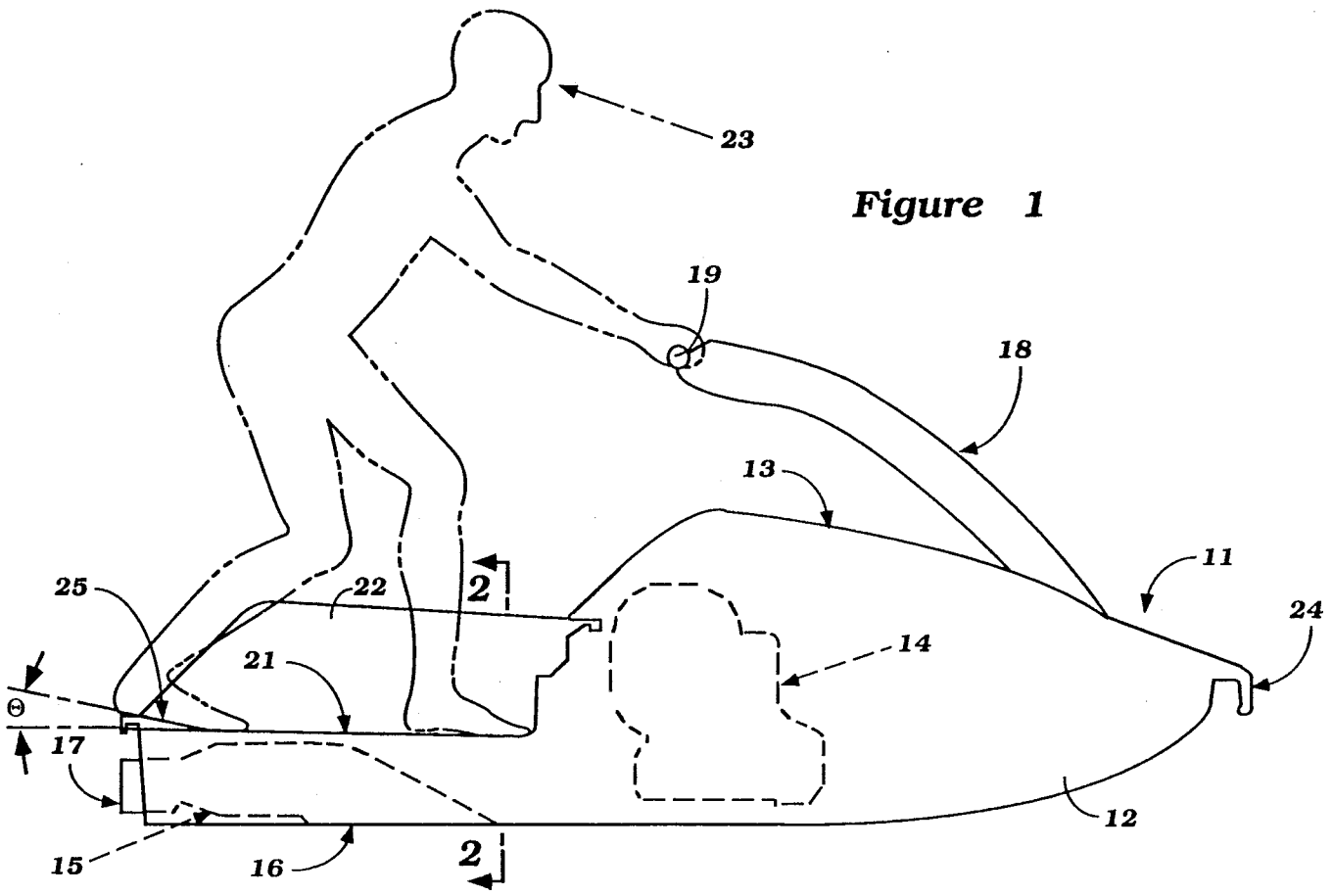
FIG. 1 is a side elevational view of a small watercraft constructed in accordance with an embodiment of the invention with the rider being shown operating the watercraft in a standing fashion.
Figure 2:
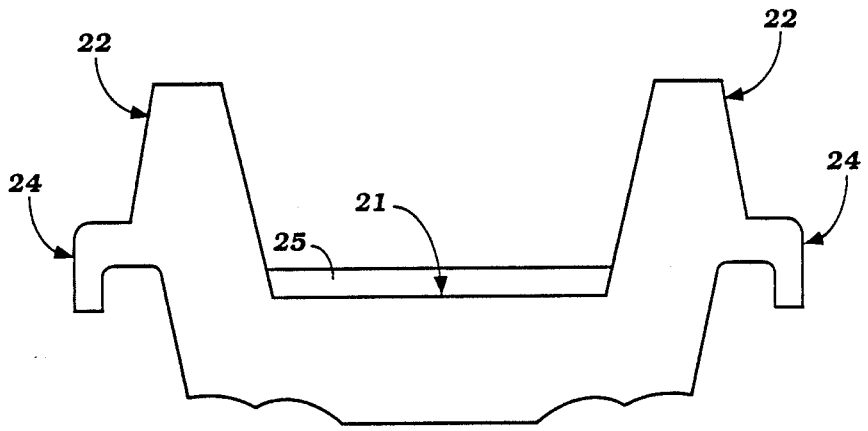
FIG. 2 is a cross-sectional view taken along the line 2—2 of FIG. 1.

Referring now in detail to the drawings, a small watercraft constructed in accordance with an embodiment of the invention is identified generally by the reference numeral 11. The watercraft 11 is comprised of a hull, indicated generally by the reference numeral 12 and which may be formed of molded fiberglass or the like. There is provided a hatch area 13 forwardly of the hull 12 and which is positioned above a powering internal combustion engine which may be of any known type and is shown schematically at 14.

Figure 3:
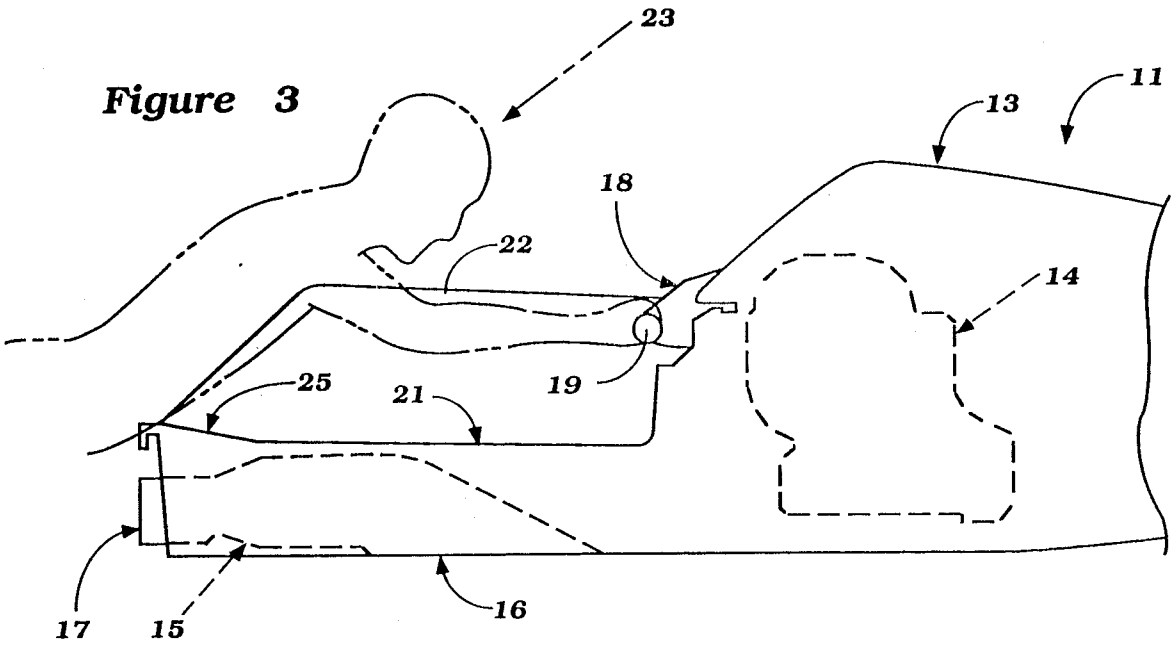
FIG. 3 is a partial side elevational view showing how the rider may enter the watercraft from the rear and particularly the initial stage of rear entry.
Figure 4:
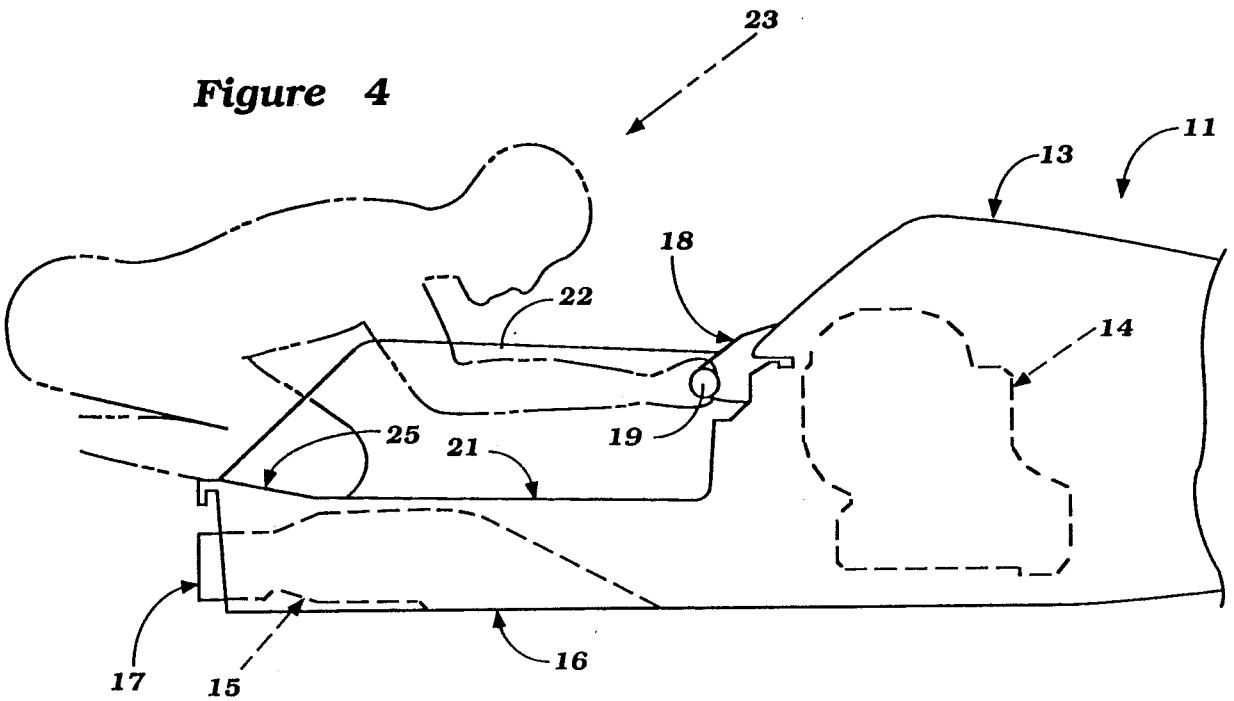
FIG. 4 is a partial side elevational view, in part similar to FIG. 3, showing a further step in the rider's entry.
Figure 5:
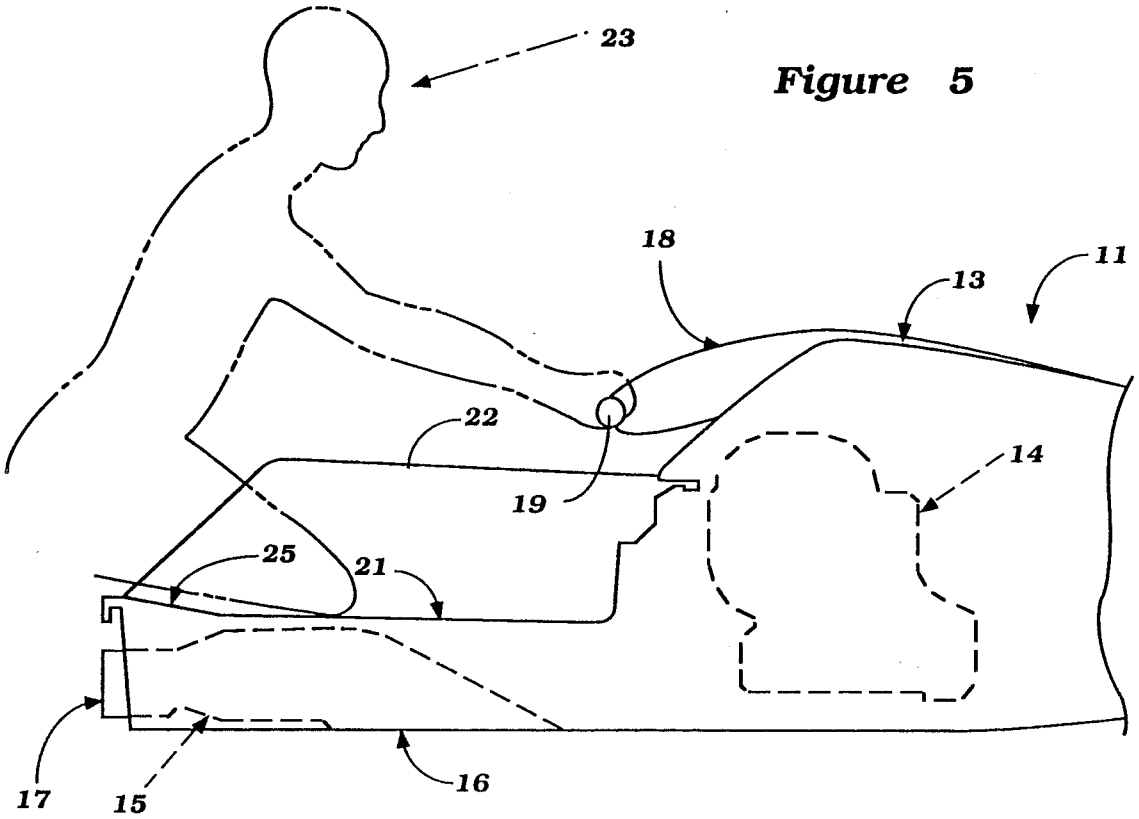
FIG. 5 is a partial side elevational view, in part similar to FIGS. 3 and 4 and showing the completion of the entry of the rider onto the watercraft.

The engine 14 drives a jet propulsion unit, indicated generally by the reference numeral 15 that is positioned rearwardly within the hull 12 and normally within a tunnel area formed at the rear of the hull. A downwardly and forwardly facing water inlet 16 of the jet propulsion unit draws water in under the operation of an impeller (not shown) that is driven by the engine 14 for discharge through a steering nozzle 17. The steering nozzle 17 is supported for steering movement and is steered by means of a steering mast 18. The steering mast 18 is pivotally supported about a transversely extending axis from a lowered position, as shown in FIGS. 3 through 5, and a raised position as shown in FIG. 1. In addition to this steering movement, the mast 18 may be steered about a vertically extending axis by means of a pair of handlebar assemblies 19 for steering the nozzle 17 in a manner well known in this art.

Rearwardly of the mast 18 and hatch 13, there is provided a rider's area that is defined by a floor 21 and which is encircled on opposite sides by raised gunnels 22. The floor 21 opens rearwardly below the gunnels 22 so that any water that enters the watercraft can be easily discharged. The rider, shown in phantom and identified by the reference numeral 23 normally operates the watercraft 11 in a standing position.

A downwardly configured fender or bumper 24 is formed around the periphery of the hull 12.

In accordance with the invention, there is provided an upwardly inclined rearward portion 25 at the rear end of the floor 21 immediately adjacent the rear opening where the floor 21 passes through the rear portion of the hull 22. The length of the inclined portion 25 is preferably in the range of ten to thirty centimeters and has an angle $\theta$ of something within the range of 4:10 to 1:30. As a result, the relatively shallow incline permits water to flow freely in and out of the floor area but also affords a sufficient incline so as to provide a good grip for a rider's feet as clearly shown in FIG. 1. However, the rise of the rear portion 25 is not significant so as to interfere with the rider's rear entry of the watercraft from the rear as may be seen in FIGS. 3 through 5.

As may be seen in FIG. 3, the rider 10 may grip the handle grips 19 and draw himself forwardly over the raised portion 25. As the rider moves forwardly as shown in FIG. 4, he may move his knees upwardly and slide them over the raised portion 25 so as to permit the completion of entry to the position shown in FIG. 5. As a result, a very stable floor is provided which does not interfere with the normal functions but provides the added functions of giving a gripping area and permitting the rider to shift his position with confidence.

Although an embodiment of the invention has been illustrated and described, it is to be understood that various changes and modifications may be made without departing from the spirit and scope of the invention, as defined by the appended claims.

We claim:

1. In a hull configuration for small watercraft having a steering mast positioned in front of a recessed rider's area for steering of said watercraft, said rider's area being defined by an uninterrupted floor extending between upstanding gunnels and opening through the rear of said hull for permitting water to flow rearwardly from said rider's area back through the open end thereof for accommodating a rider standing thereon, the improvement comprising said floor area having a generally flat forward portion and a rear portion adjacent the opening at the end thereof inclined upwardly from said flat portion toward the rear end of said hull for affording a bracing area for the feet of the standing rider without offering significant obstruction to water flow from the rider's area and rear entry of the rider to the rider's area.

2. In a hull configuration for a small watercraft as set forth in claim 1 wherein the inclined rear portion is in the range of ten to thirty centimeters long.

3. In a hull configuration for a small watercraft as set forth in claim 1 wherein the inclined rear portion has an inclination in the range of 4:10 to 1:30.

4. In a hull configuration for a small watercraft as set forth in claim 3 wherein the inclined rear portion is in the range of ten to thirty centimeters long.

* * * * *